US010127916B2

(12) United States Patent
Gao et al.

(10) Patent No.: US 10,127,916 B2
(45) Date of Patent: Nov. 13, 2018

(54) METHOD AND APPARATUS FOR ENHANCING ALVEOLAR TRILL

(71) Applicant: MOTOROLA SOLUTIONS, INC, Chicago, IL (US)

(72) Inventors: Yi Gao, Chengdu (CN); Qing Yan, Chengdu (CN)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 275 days.

(21) Appl. No.: 15/127,422

(22) PCT Filed: Apr. 24, 2014

(86) PCT No.: PCT/CN2014/076164
§ 371 (c)(1),
(2) Date: Sep. 20, 2016

(87) PCT Pub. No.: WO2015/161493
PCT Pub. Date: Oct. 29, 2015

(65) Prior Publication Data

US 2017/0148463 A1 May 25, 2017

(51) Int. Cl.
*G10L 19/06* (2013.01)
*G10L 19/26* (2013.01)
(Continued)

(52) U.S. Cl.
CPC ..... *G10L 19/265* (2013.01); *G10L 19/0018* (2013.01); *G10L 19/16* (2013.01);
(Continued)

(58) Field of Classification Search
None
See application file for complete search history.

(56) References Cited

U.S. PATENT DOCUMENTS 6,912,499 B1 6/2005 Kondo et al.
9,640,185 B2 * 5/2017 Kushner ..... G10L 21/02
(Continued)

FOREIGN PATENT DOCUMENTS

CN 101004915 A 7/2007
EP 1251490 A1 10/2002

OTHER PUBLICATIONS

R. Schwartz et al., "Diphone Synthesis for Phonetic Vocoding", Proc. IEEE-ICASSP, Apr. 1979, pp. 891-894 (Year: 1979).*
(Continued)

*Primary Examiner* — Richard Z Zhu
(74) *Attorney, Agent, or Firm* — Barbara R. Doutre

(57) ABSTRACT

A method and apparatus for enhancing audio processing between a transmit radio (230) and a receive radio (240) are provided. Digitized audio frames (202) are applied to parallel inputs of both a vocoder encoder (204) and a trill encoder 212 of the transmit radio (230). The vocoder encoder (204) generates voice bits which are communicated over a voice bits channel (206) to a vocoder decoder (208) of the receive radio (240). Trill encoder (212) generates signaling bits which are communicated over a signaling bits channel (214) to a trill decoder (216) of the receive radio (240) for recovery of trill information (218). At the receive radio (240), a decoded audio signal (209) generated from the vocoder decoder (208), and the recovered trill information (218) are both provided as inputs to a trill reconstructor stage (220) to generate a recovered audio signal (222) having a reconstructed trill.

23 Claims, 9 Drawing Sheets

(51) Int. Cl.

| | |
|---|---|
| ***G10L 19/00*** | (2013.01) |
| ***G10L 25/87*** | (2013.01) |
| ***G10L 19/16*** | (2013.01) |
| *G10L 19/02* | (2013.01) |
| *G10L 25/75* | (2013.01) |
| *G10L 21/02* | (2013.01) |

(52) U.S. Cl.

CPC ..... *G10L 25/87* (2013.01); *G10L 19/00* (2013.01); *G10L 19/0019* (2013.01); *G10L 19/02* (2013.01); *G10L 21/02* (2013.01); *G10L 25/75* (2013.01)

(56) References Cited

U.S. PATENT DOCUMENTS 9,640,193 B2 * 5/2017 Kong ..... H04R 1/08
9,679,575 B2 * 6/2017 Deleeuw ..... G10L 15/24
2007/0213987 A1 * 9/2007 Turk ..... G10L 13/033 704/268
2011/0264441 A1 10/2011 Chandrasekhar
2013/0191115 A1 * 7/2013 Suzuki ..... G10L 21/06 704/9
2014/0276228 A1 * 9/2014 De Waele ..... A61B 5/0826 600/586

OTHER PUBLICATIONS

R Schwartz et al., "A preliminary design of a phonetic vocoder based on a diphone model", Acoustics Speech & Signal Proc. IEEE Int'l. Conference on ICASSP 80, vol. 5, pp. 32-35, 1980 (Year: 1980).*

Pandey et al., "Estimation of Place of Articulation During Stop Closures of Vowel-Consonant-Vowel utterances", IEEE Transactions on Audio, Speech, and Language Processing, vol. 17, No. 2, Feb. 2009, pp. 277-285. (Year: 2009).*

The International Search Report and the Written Opinion, SN: PCT/CN2014/076164, filed: Apr. 24, 2014, all pages.

* cited by examiner

METHOD AND APPARATUS FOR ENHANCING ALVEOLAR TRILL

FIELD OF THE DISCLOSURE

The present disclosure relates generally to radio communications and more particularly to the processing of speech signals in radio communication devices.

BACKGROUND

Land mobile radios providing two-way radio communication are utilized in many fields, such as law enforcement, public safety, rescue, security, trucking fleets, and taxi cab fleets to name a few. Land mobile radios include both vehicle-based and hand-held based units. Digital land mobile radios have additional processing inside the radio to convert the original analog voice into digital format before transmitting the signal in digital form over-the-air. The receiving radio receives the digital signal and converts it back into an analog signal so the user can hear the voice. Examples of digital radio are radios that comply with the APCO-25 standard or TETRA standard. However, digital radios have sometimes been perceived to distort certain speech sounds. The alveolar trill can exist in many languages, such as Spanish, Italian, Finnish, Catalan, Swedish, Hungarian, Polish, Czech, Basque, Lithuanian, Arabic, and Tamil to name a few. In particular, speech sounds having alveolar trills, such as the rolled 'r' used in Spanish and Italian languages, can be perceived as sounding distorted, flat or slurred when heard through a digital radio. Phonetic information may also be carried by certain trill sounds, and thus some speakers may be more sensitive to variations in radio speech intelligibility than others.

In radio operation, incoming audio speech into a microphone is converted by an analog-to-digital (A/D) converter) resulting in digitized speech signal which is input to a vocoder. Narrowband vocoders are used in digital radio products. FIG. 1 is a graphical example 100 comparing pre-vocoder trill sounds to post-vocoder trill sounds in accordance with the prior art. Graphs 102 and 104 show time versus amplitude for two speech samples. Uncoded alveolar trills 106 and 110 (pre-vocoder) are shown in graph 102. Corresponding post-vocoder coded/decoded alveolar trills 108 and 112 are shown in graph 104. As shown in graph 104, the alveolar trills 108 and 112 are smeared and are thus not encoded correctly by the narrowband vocoder causing intelligibility problems, especially in Italian and Spanish. Because vocoders are typically regulated by the standard within which they operate, they cannot be easily modified.

Accordingly, a means to improve the fidelity of vocoded higher modulation rate speech sounds without modifying the vocoder is needed.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
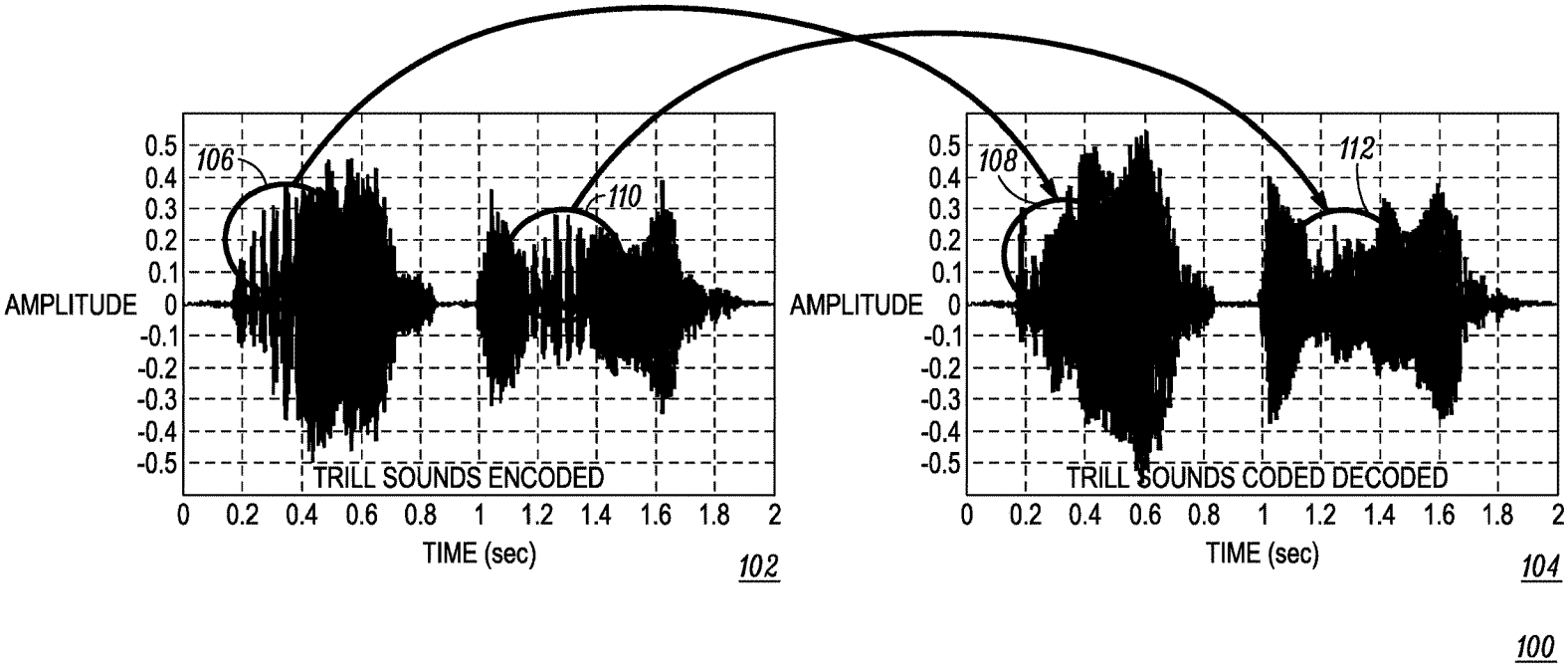
(PRIOR ART) FIG. 1
FIG. 1 is a graphical example comparing pre-vocoder trill sounds to post-vocoder trill sounds in accordance with the prior art.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, there are described herein methods and apparatus for enhancing the modulation index of speech sounds passed through a digital vocoder. Methods for improving high modulation rate sound encoding, particularly for trill sound intelligibility, are provided. The methods and apparatus address speech envelope modulation coding errors caused by the slow frame energy analysis rate inherent in low bit rate parametric vocoders, such as the Improved Multi-Band Excitation (IMBE™) and Advanced Multi-Band Excitation (AMBE©) class of vocoders produced by DVSI Inc. Speech envelope modulation coding errors and aliasing artifacts caused by the sub-Nyquist frame rate used in narrowband vocoders are resolved.

Narrowband vocoders are used in digital radio products. Depending on type of vocoding techniques, the vocoder also "compresses" the resulting sample so that it can fit into a narrower bandwidth. The information content of human speech is encoded by the vocoder using acoustic frequency and amplitude modulation. The phonemic information stream is broken into syllables encoded as energy envelope modulation. The syllabic modulation rate of speech is typically less than 16 Hz with the vast majority of amplitude modulation energy occurring in the 0.5-5 Hz range. However, as mentioned previously in some languages, such as Italian and Spanish, certain sounds, most notably the alveolar trill (e.g. trilled "r"), carry important phonemic information encoded in amplitude modulation at a higher rate of from 20-40 Hz. In low bit rate parametric vocoders, the signal energy parameter which encodes the waveform amplitude modulation is calculated at a low frame rate, typically 50 frames/sec or less. In addition, frame overlapping and other forms of parameter smoothing are employed to reduce coding artifacts. For languages such as English with low syllabic modulation rates this is not a problem. However, for sounds that are defined by a higher amplitude modulation rate such as the alveolar trill, vocoding can cause the energy modulation component to be poorly defined due to frame smoothing and aliasing, reducing the perceptibility and intelligibility of the sound. While a straightforward solution would be to increase the frame analysis rate, this cannot be done without increasing the vocoder bit rate or modifying the vocoder parameter rate in some other way. Because vocoders are typically regulated by the standard within which they operate, they cannot be easily modified.

In accordance with the various embodiments, a parallel and post-processing approach is provided to enhance certain types of speech sounds being generated through a digital narrowband vocoder system. The parallel and post-processing approach is provided by a processing module within a transmit radio and a similar module within a receive radio, the module providing a plurality of processing stages which provide trill encoding at the transmit side, and trill decoding with trill reconstruction at the receive side, to enhance trilled speech sounds, particularly the alveolar trill, to make them more perceptible after passing through the narrowband vocoder. Narrowband vocoders typically employ a frame analysis rate that is too low for accurately reproducing higher frequency speech amplitude modulations. Since the frame rate of the vocoder cannot be increased, the plurality parallel and post-vocoder processor modules provided herein are utilized to enhance the modulation though the detection of trill nulls and coding of trill information into a plurality of bits at the transmit side. These bits are sent in a parallel path to the receive side via a signaling bits channel where a trill decoder recovers the trill information based on the received trill bits. A trill reconstructor then reshapes the waveform at the output of the vocoder decoder (post vocoder-decoder) based on the recovered trill information.

Figure 2:
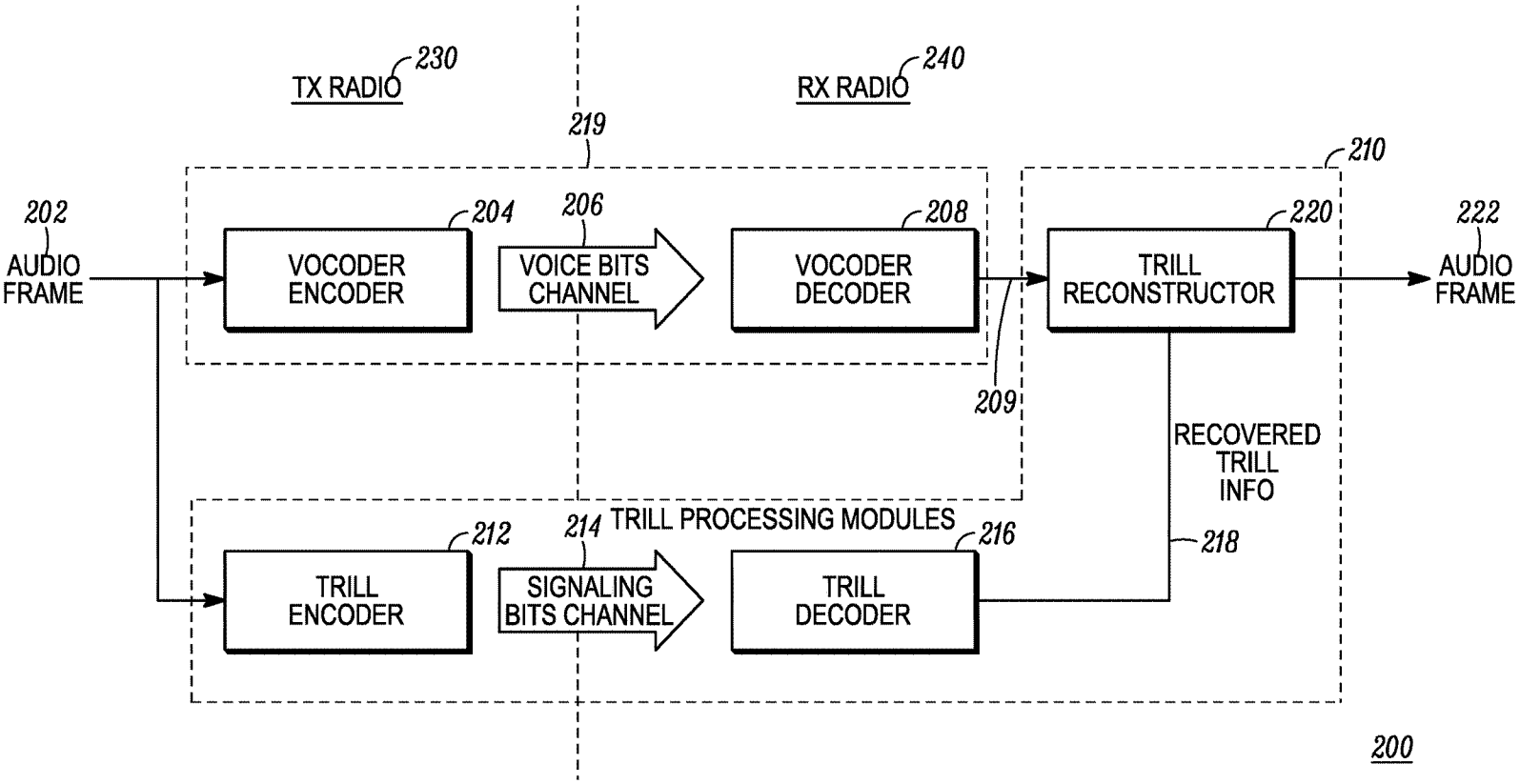
FIG. 2 is a block diagram of a speech enhancement approach for a communication system in accordance with various embodiments.

FIG. 2 is a block diagram of a speech enhancement approach for a communication system 200 in accordance with various embodiments. The speech enhancement approach of communication system 200 improves sound intelligibility for signals processed through a digital narrowband vocoding system 219 operating between two radios, a transmit (TX) radio 230 and a (RX) receive radio 240.

In operation, incoming audio speech into a microphone is converted by an analog-to-digital (A/D) converter resulting in digitized audio frames 202 which are input to the digital vocoding system 219 and output from the digital vocoding system as a decoded audio signal 209 at a predetermined frame rate. The digital vocoding system 219 comprises a vocoder encoder 204 and vocoder decoder 208 to differentiate between signals being processed at the TX radio 230 and signals being processed by the RX radio 240. Communication between the vocoder encoder 204 and vocoder decoder 208 takes place via a voice bits channel 206 which may comprise any wireless digital audio communication channel. In the vocoder encoder 204 of TX radio 230, the digitized input audio frames 202 are passed through various processing stages, for example, speech parameter analysis and quantization stages, resulting in voice bits which are communicated, over the voice bits channel 206, to the vocoder decoder 208 of RX radio 240. The vocoder decoder 208 synthesizes the speech signal based on the received voice bits to generate the decoded audio signal 209. In accordance with the various embodiments, the decoded audio signal 209 is then sent to a post-vocoder processing stage comprising a trill reconstructor 220 (to be described later).

In accordance with the various embodiments, the speech enhancement approach of communication system 200 further comprises a plurality of trill processing modules or stages 210 providing parallel-vocoding and post-vocoding trill processing. The trill processing modules 210 may comprise one or more processing devices in each radio 230, 240, such as a digital signal processing device, codec or other ASIC type integrated circuits. Alternatively the functionality of the trill processing modules may be integrated as part of each radio's main microcontroller or a software component of each radio's digital signal processor. Thus, the speech enhancement approach for communication system 200 need not involve increased parts count or additional manufacturing steps.

In accordance with the various embodiments, the trill processing module 210 of TX radio 230 comprises a trill encoder 212, and the RX radio 240 comprises a trill decoder 216 and a trill reconstructor 220. In accordance with the various embodiments, the digitized audio frames 202 are supplied to parallel inputs of vocoder encoder 204 and the trill encoder 212. The parallel processing continues as the output of the vocoder encoder 204 is transmitted over voice bits channel 206 to the vocoder decoder 208 of the RX radio 240, and the output of the trill encoder 212 is transmitted over signaling bits channel 214 to the trill decoder 216 of the RX radio 240. The decoded audio signal 209 output from the vocoder decoder 208 along with the recovered trill information 218 are then both provided as inputs to the trill reconstructor 220 as part of post-vocoding processing. Thus, a combination parallel vocoding processing and post-vocoding processing is achieved. The processing occurring within each stage or module is described next.

Trill encoder 212 analyses consecutive audio frames from input audio frames 202, in terms of acoustic characteristics, such as amplitude envelope changes over time, to detect trill nulls and determine the acoustic information that benefits the trill sound perception, referred to as trill information or trill info, then codes this information into signaling bits. These signaling bits are then sent to the signaling bits channel 214 for transmission.

The signaling bits channel 214 provides the logic or physical channel which is able to transmit the signaling bits from the trill encoder 212 of TX radio 230 to the trill decoder 216 of RX radio 240. The signaling bits channel 214 may reuse part of voice bits channel 206 or any other kind of reserved/extendable bits of a communication channel. For example, for a voice bit rate of 36 bits/20 ms, if it is desired to transmit two trill bits every speech frame, then 34 bits/20 ms could be used to code speech frames without perceptible speech quality degradation. This would allow for a saved 2 bits/20 ms with which to transmit the trill bits.

In accordance with the various embodiments, the trill decoder 216 extracts trill bits from amongst the received bits received from signaling bits channel 214. For example, the trill decoder 216 may extract the trill bits by detecting trill bit positions at predetermined correct positions before and after channel decoding, and or some other manipulation. The channel decoding may comprise forward error correction (FEC) decoding which generally takes place before vocoder decoding in a radio system.

The trill decoder 216 decodes and recovers the trill information, such as trill null position and trill modulation depth (trill modulation depth may also be referred to as trill depth or modulation depth), by inverting the procedures exploited in trill encoder 212, thereby generating recovered trill information 218. The recovered trill information 218 is then sent to the trill reconstructor 220.

In accordance with the various embodiments, the trill reconstructor 220 determines the audio reshaping of the decoded audio signal 209 from the vocoder decoder 208 based on the recovered trill information 218 decoded by trill decoder 216. The trill reconstructor 220 (a post vocoder-decoder module) thus generates recovered audio output 222 having a reconstructed trill.

Accordingly, the speech enhancement approach of communication system 200 achieves speech enhancement with a combination of both parallel-vocoding and post-vocoding processing. The speech enhancement approach of communication system 200 can be summarized by the Table below:

| | Parallel-vocoding processing | Post-vocoding processing |
|---|---|---|
| Trill Encoder 212 (TX RADIO) | Trill encoder 212 analyses consecutive audio frames 202 for acoustic characteristics to detect trill nulls, determine acoustics to generate trill info, then codes this trill info into bits and sends to signaling bits channel 214 for transmission. | |
| Signaling Bit Channel 214 (Radio Channel) | Signaling Bits Channel 214 is the logic or physical channel which is able to transmit signaling bits | |
| Trill Decoder 216 (RX RADIO) | Trill Decoder 216 extracts trill bits from Signaling Bits Channel 214, then the trill info, is decoded and recovered by inverting the procedures exploited in Trill Encoder 212 | |
| Trill Reconstructor 220 (RX RADIO) | | Based on recovered trill info 218 decoded by trill decoder 216, trill reconstructor determines audio reshaping strategy for decoded audio signal 209 from vocoder decoder 208 |

Figure 3:
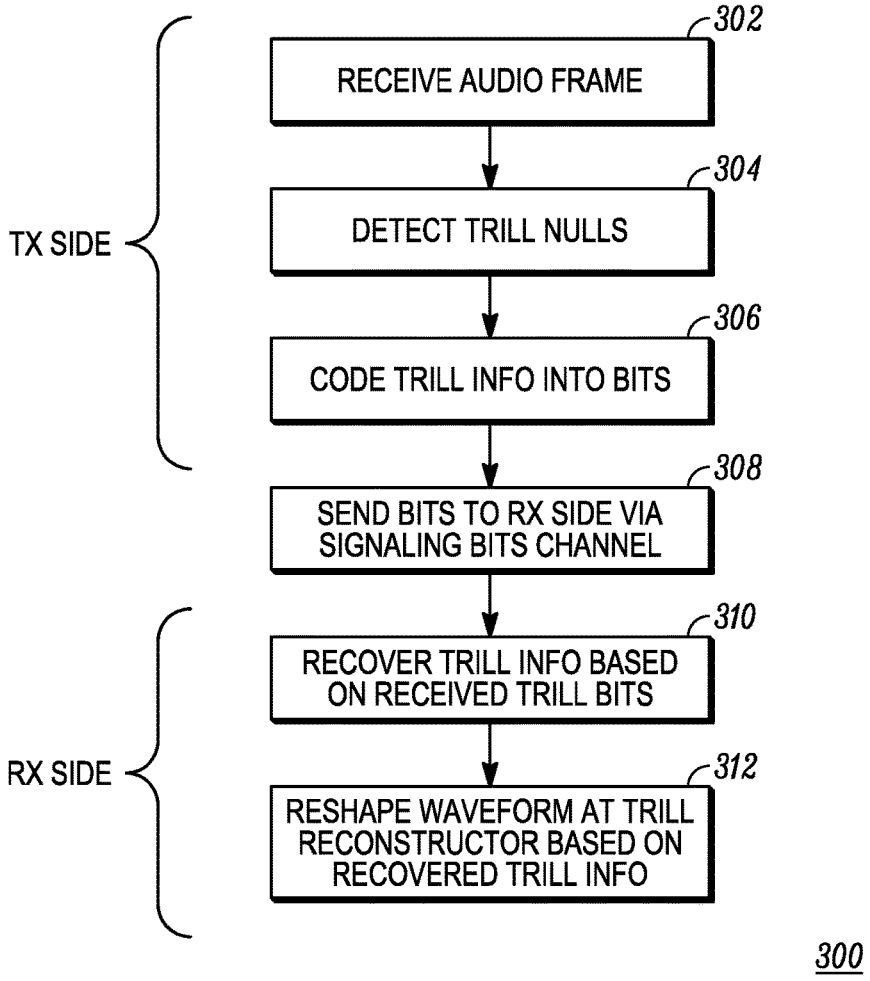
FIG. 3 is a method outlining the steps taking place in the trill processing modules of FIG. 2 for speech enhancement in accordance with various embodiments.

FIG. 3 is a method outlining the steps taking place in the trill processing modules 210 of FIG. 2 for speech enhancement in accordance with various embodiments. Method 300 begins at the transmit side (TX radio 230) by receiving audio frames at 302. The audio frames received at 302 align with the digitized audio frames 202 of FIG. 2. The method 300 then continues by detecting trill nulls at 304 followed by the coding of the trill nulls into trill information bits at 306. These steps take place along the parallel path at trill encoder 212 of FIG. 2. At 308, the method continues by sending the trill information bits generated at 306 over to the receive side via the signaling bits channel 214, shown in FIG. 2.

Method 300 continues at 310 at the receive side (RX radio 240), by recovering trill information based on the received trill bits. The recovery is accomplished using the trill decoder 216 of FIG. 2. Method 300 continues at 312 by reshaping the decoded audio signal 209 based on the recovered trill information 218 input to the trill reconstructor 220. For example, the trill reconstructor 220 can determine sample gains based on recovered trill information 218 and some predefined parameters. Examples of these predefined parameters may comprise the algorithm delay of the vocoder encoder and vocoder decoder of the vocoding system 219, upper and lower thresholds of the sample gains, and smoothing factors when ramping the sample gains down and ramping the sample gains up. The smoothing factor values can be different between ramping down and ramping up the sample gains. The sample gains are then applied to the decoded audio signal 209 through trill reconstructor 220.

Figure 4:
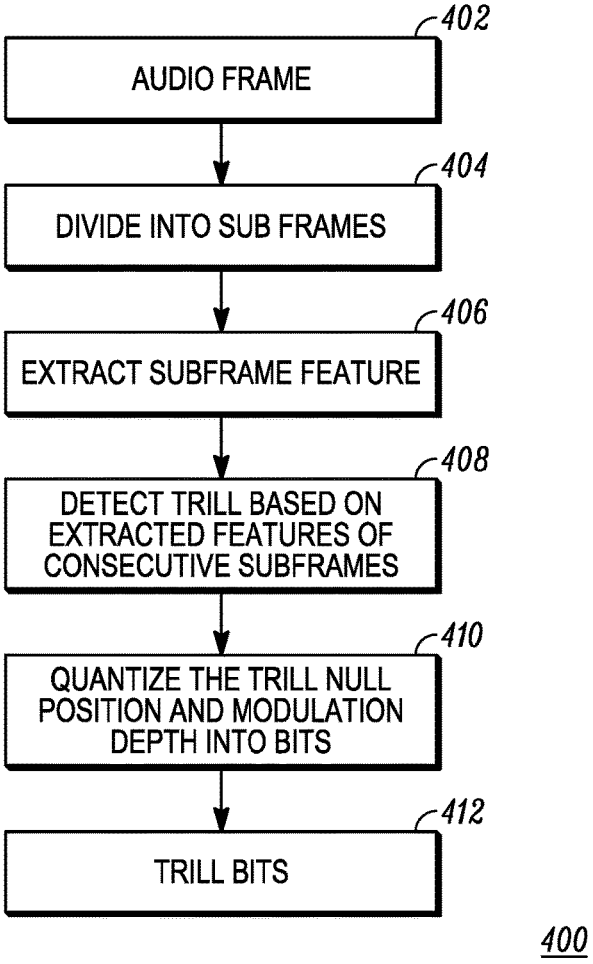
FIG. 4 is a method for trill encoding in accordance with various embodiments.

FIG. 4 is a method for trill encoding in accordance with various embodiments. These steps are performed by the trill encoder 212 of the TX radio 230 of FIG. 2. The method begins at 402 by receiving an audio frame, such as digitized audio frame 202 of FIG. 2. For example, a 20 ms audio frame (160 samples if sampling rate is 8 kHz) may be divided into 2 sub frames (80 samples each). The method 400 continues by dividing the sampled audio frame into sub frames at 404. Additionally, the audio frame may be divided into smaller sub frames (for example 53, 53, 54 samples each).

Different sampling and sub frames can be used depending on the type of system. The previous example is based on a radio system that samples the audio signal at an 8000 Hz sampling rate, then a 20 ms speech frame comprises 0.020 s*8000 Hz=160 samples. Small sub frames could be 10 ms each, so a 20 ms frame contains 2*10 ms sub frames with 80 samples each. The sub frame length can be any value smaller than 20 ms and there can be overlap between two sub frames.

Following 404, the method continues by extracting sub frame features at 406. For example, the extraction may be accomplished by band pass filtering the sub frames in the audio frequency range of (300 Hz~2000 Hz) to obtain the voiced sound band energy and then calculating a maximal absolute amplitude or a root mean square (rms) level of each sub frame. A lower limit can be set for the absolute amplitude to avoid impact caused by background noise. Alternatively, the lower limit could be set by averaging the background noise absolute amplitude in real-time.

The method 400 continues by moving to 408 and detecting the trill based on the extracted features of consecutive sub frames. The trill may be detected by, for example, calculating the amplitude (amp) changes of two consecutive sub frames in decibels (dB):

ampUpdateInDB = 20 * log( maxAmp1 / maxAmp2 ),
where maxAmp1 is from the $1^{st}$ sub frame.

Continuing with the trill detection example, for the latest 3 sub frames, three values of the amplitude changes can be obtained for each 10 ms sub frame:

```
ampUpdateInDB[0] ~ ampUpdateInDB[2],
smaller index indicates the value worked out when processing an
earlier sub frame.
```

Based on these three values, logic can be used to detect a trill null and its modulation depth. An example embodiment of such detection is:

```
IF ( (ampUpdateInDB[0]+ampUpdateInDB[1] > DB_DECREASE) OR
(ampUpdateInDB[1] > DECTHRESH ) ) AND (-ampUpdateInDB[2]>
DB_INCREASE))
THEN modulateDepth = MAX(ampUpdateInDB[0]+ampUpdateInDB[1],
ampUpdateInDB[1])
```

The trill null position and modulation depth have thus been determined at 408. The method 400 then continues to 410 by quantizing the trill null position and modulation depth into bits. For example, to quantize the trill info into N bits, take N=3 as example:

```
Bit[0] is the trill null position bits, 0 if the trill null is a 1st 10ms
subframe or 1 if is at the 2nd subframe.
Bit[1] and bit[2]: the modulationDepth is non-linearly quantized
into 2 bits(0~3):
0 if no trill null detected,
1 if modulationDepth < 5dB,
2 if modulationDepth < 12dB,
3 if modulationDepth >= 12dB.
```

By quantizing the trill null position and modulation depth at 410, the trill bits are provided as output at 412 from trill encoder 212 of TX radio 230.

Figure 5:
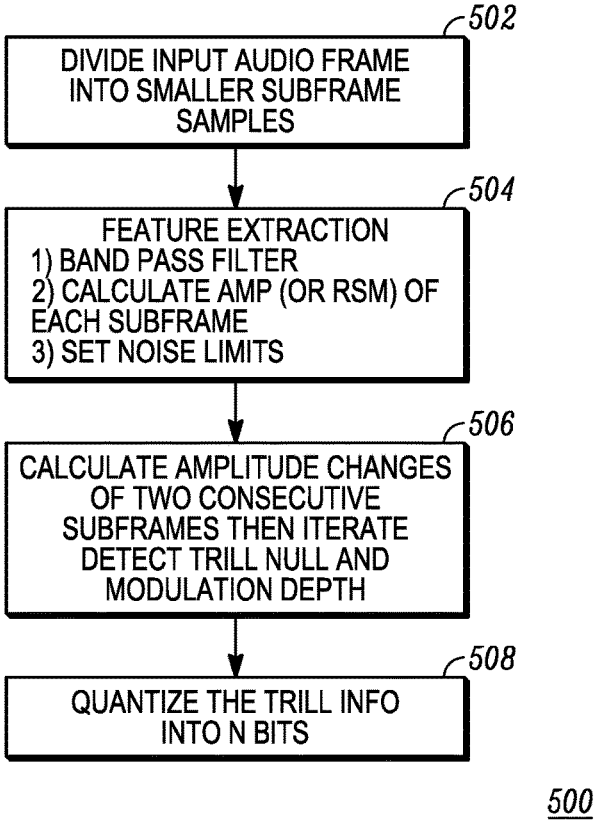
FIG. 5 is a more detailed embodiment for the method of trill encoding of FIG. 4 in accordance with the various embodiments.

FIG. 5 provides a more detailed embodiment for the method of trill encoding of FIG. 4. Beginning at 502, the TX radio 230 takes the received audio frame and divides it into smaller sub frame samples. The feature extraction step described at 406 of FIG. 4 may be performed at 504 by filtering the sub frame samples through a band pass filter and calculating the maximal absolute value of amplitude e.g., max(abs(amp)) or by calculating a root mean square (rms) of each sub frame. The impact caused by background noise may be avoided by setting predetermined noise limits.

The trill detection 408 can be accomplished at 506 by calculating the amplitude changes of two consecutive sub frames and then iterated to detect the trill null and modulation depth. The extracted trill information, pertaining to trill null position and modulation depth, is then quantized into N bits at 508.

Figure 6:
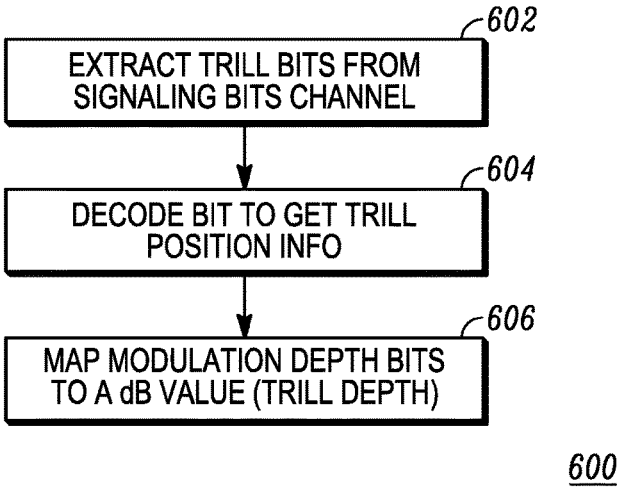
FIG. 6 is a method of trill decoding in accordance various embodiments.

FIG. 6 is a method for trill decoding in accordance with the various embodiments. The trill decoding method 600 takes place at trill decoder 216 of the RX radio 240 of FIG. 2. Method 600 begins at 602 by extracting trill bits from the signaling bits channel 214. The trill bits can be extracted according to a predetermined strategy from the signaling bits channel 214. For example, the bits can be extracted from stolen bit positions before Forward Error Control (FEC) decoding, or the bits can be extracted from predetermined bit positions after FEC. The extracted trill bits are then decoded to obtain trill null position information at 602 and modulation depth at 606.

An example embodiment of trill decoding comprises supplying the signaling bits channel 214 with AMBE stolen bits by operating the trill decoder 216 in bit-stealing mode, where at most 6 bits could be used to transmit any signaling info from the signaling bits channel 214 into the trill decoder 216. Another example embodiment of trill decoding comprises supplying the signaling bits channel 214 with reserved protocol bits. And another example embodiment of trill decoding comprises supplying the signaling bits channel 214 with replacing less important voice bits with trill bits. Another example embodiment for trill decoding is to use different channel encoding that uses less channel bits for the radio signaling bits channel 214 to save bandwidth for trill bits transmission to the trill decoder 216.

To summarize, the trill decoder 216 extracts trill bits from the signaling bits channel 214, decodes the bits to get trill null position information, and then maps the modulation depth in decibels (dB). The method 600 supports trill decoding and provides the reverse process of the trill encoder 212. As a logic example, the method 600 might comprise:

decoding bit[0] to obtain the trill null position info;

mapping modulation depth bits (0~3) to a dB value (call as trill depth) by checking a lookup table to recover the trill null amplitude, such as the following table [0, 4, 9, 14]:

0 indicating no trill null detected 1 indicating 4 dB decrease of the amplitude at the trill null 2 indicating 9 dB decrease 3 indicating 14 dB decrease.

In the above look up table example, [0, 4, 9, 14] indicates the decoded trill depth, where 0 means no trill null detected, the remaining values indicate there is a trill null detected, and the number is the thrill depth. Another alternative is to compare the trill depth to a predetermined threshold N, where N is a small number of dB value. If the trill depth is smaller than N, then the trill null detect flag is set, or it is cleared. For example, the flag can be set to 1 to indicate there is a trill null detected, and 0 to indicate that no trill null is detected.

Figure 7:
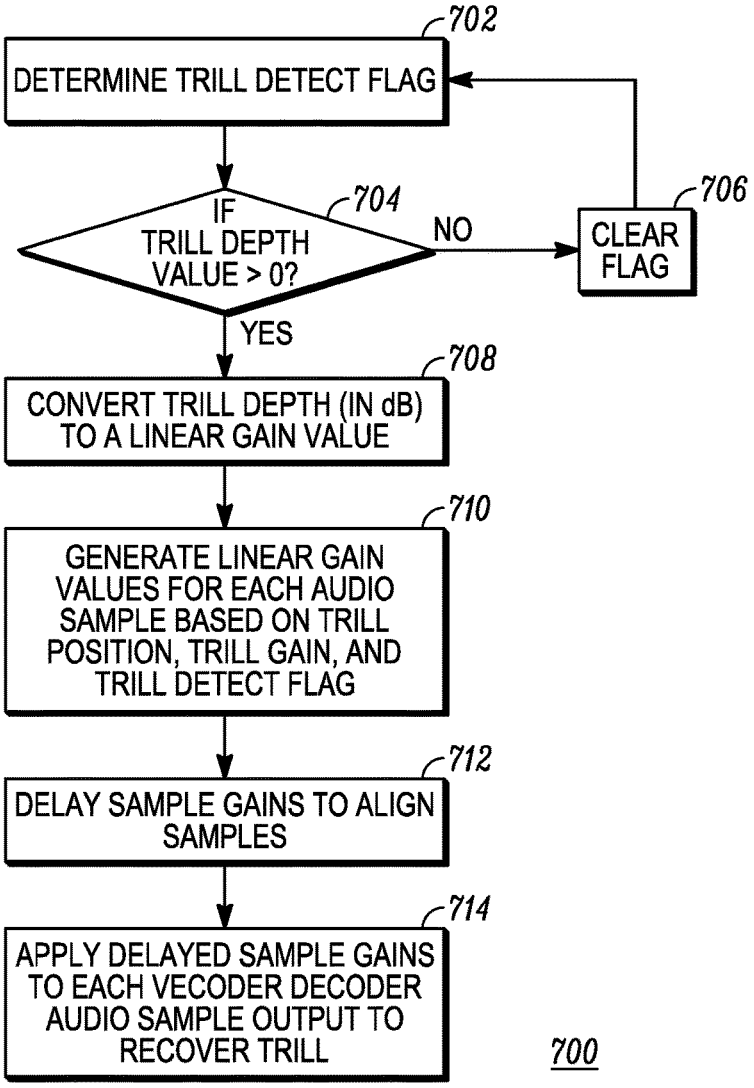
FIG. 7 is a method of trill reconstruction in accordance with the various embodiments.

FIG. 7 is a method 700 of trill reconstruction in accordance with the various embodiments. Method 700 controls the operation of trill reconstructor 220 of RX radio 240 of FIG. 2. Method 700 begins by determining a trill detect flag at 702. This can be accomplished by comparing the trill depth, from recovered trill info 218 of FIG. 2, to a predetermined value, in this case the predetermined value being zero (0 dB) to represent a null at 704. If the trill depth exceeds 0 dB at 704, then the trill detect flag is set indicating that a trill null is detected in the current frame and the method moves on to 708. If the trill depth does not exceed 0 dB at 704, then the trill detect flag is cleared at 706 indicating that no trill null was detected.

At 708, the trill depth, which is currently in decibels (dB), is converted to a linear gain value. For example:

```
trillGain=10^(-trillDepth/20)
```

Sample linear gain values are generated at 710 for each audio sample of decoded audio signal 209 of FIG. 2, based on three parameters controlled by trill reconstructor 220, the three parameters comprising: (1) trill null position, which is included in trill info 218, (2) the linear gain value converted from trill depth, which is calculated in 708, referred to a trill gain, and (3) the trill detect flag of current and previous frames.

Figure 8:
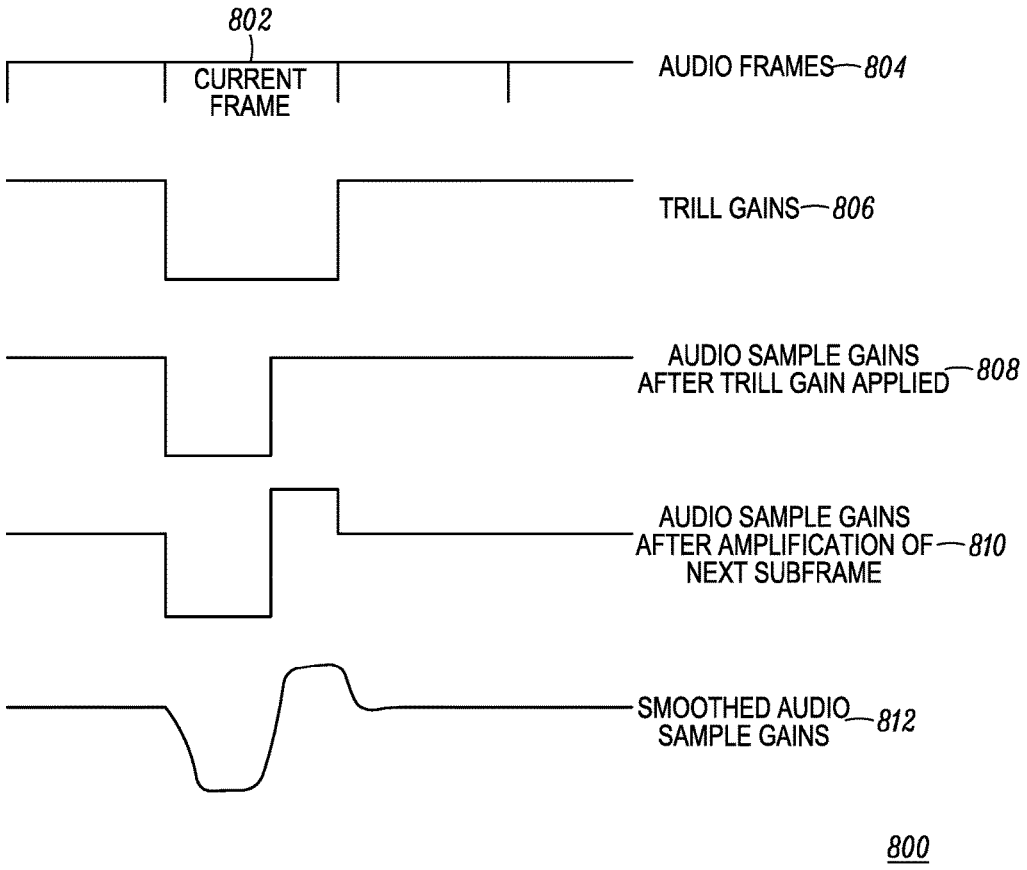
FIG. 8 is a visual example of generating the linear gain values during the trill reconstruction of FIG. 7 in accordance with the various embodiments.

Turning briefly to FIG. 8, is a visual example 800 of generating the linear gain values during the trill reconstruction of FIG. 7 is provided. In this example, audio frames 804 represent the decoded audio signal 209 coming from the vocoder decoder 208 that is divided into frames (such as 20 ms audio signal is one frame). Current frame 802 is one of the audio frames 804 that is being processed by trill reconstructor 220. Audio frames 804 are sent to trill reconstructor 220 for processing by 806~812 which are all part of the reconstructor.

If the trill detect flag shows that a trill is detected in the current frame 802 of audio frames 804, then the trill gain 806 is calculated for current frame 802 and applied to the linear gain of audio samples 808 at the proper position determined by the trill null position. As an example, at 808, the trill gain 806 is applied to the first sub frame of current speech frame 802. The trill gain could also be applied to the second sub frame of current frame depending on the trill null position parameter. But at 808, the first half position is used as an example.

Additionally, the linear gain of predetermined audio samples of the next sub frame of current speech frame 802 are boosted (amplified) to get the new audio sample gain values 810. Finally, the sample linear gain values are smoothed over time at 812.

Moving back to method 700 at 712, the sampled gains generated at 710 are delayed to align with the incoming samples to the trill reconstructor 220, these samples being the decoded audio samples 209 of FIG. 2. By applying the delayed sampled gains to each sample of the decoded audio signal 209 at 714, the trill is reconstructed and generated within recovered audio output 222 of FIG. 2.

For example, for an AMBE vocoder, the sample gains may be delayed to make them align with the AMBE algorithm delay. The AMBE encoder/decoder has a delay of approximately 44 ms, and therefore the gains generated at 714 may be delayed by approximately 44 ms as well. By applying the delayed sample gains of 714 to each sample of the AMBE decoded output audio 209, the trill is reconstructed within the recovered audio output 222.

Figure 9:
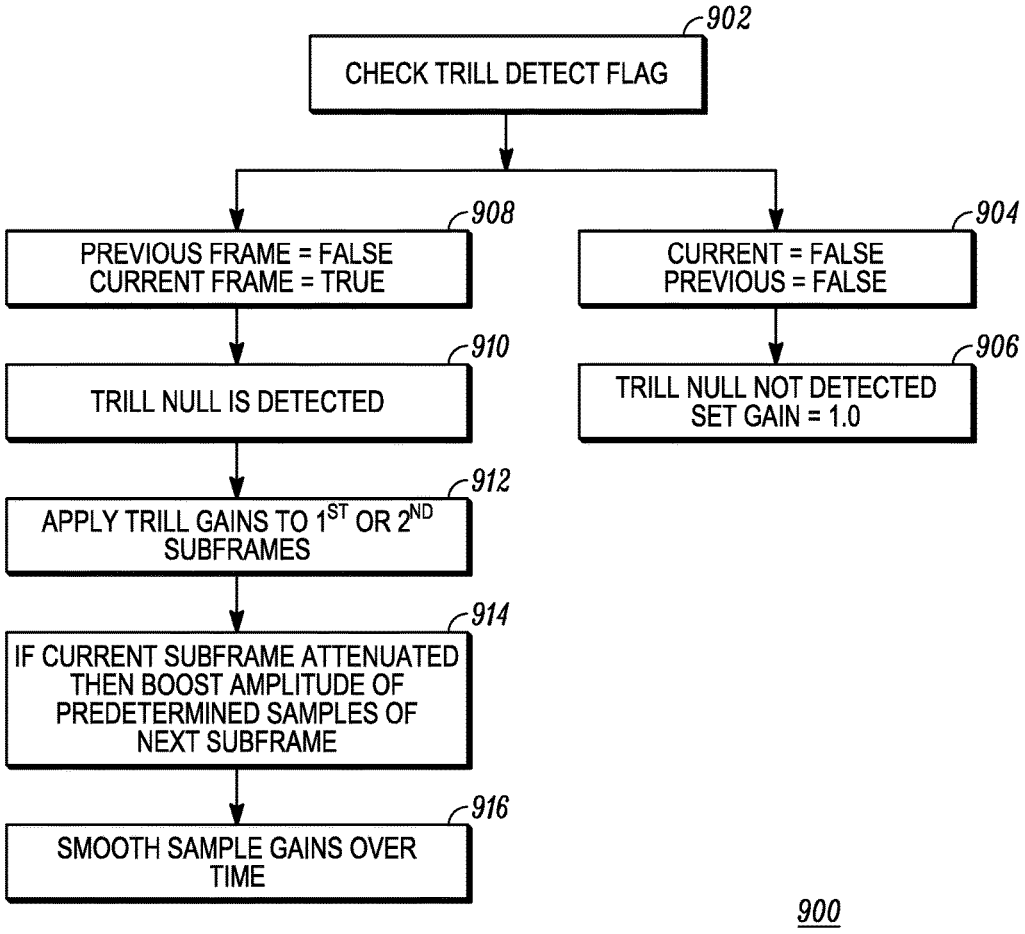
FIG. 9 is a method of sub-steps for generating the linear gain values from the method of FIG. 7 during trill reconstruction in accordance with the various embodiments.

FIG. 9 is a method 900 of more detailed sub-steps for generating the linear gain values at 710 from the method of FIG. 7 during trill reconstruction in accordance with the various embodiments. If there is a trill null, then generate raw values of sample gains are generated based on information pertaining to the trill null.

Method 900 begins by checking the trill detect flag at 902. If the trill detect flag is false for both current and previous frames at 904, then no trill null has been detected and sample gains are set to 1.0 at 906. If the trill detect flag for the previous frame is false and for current frame is true at 908, then the method has detected a trill null at 910.

When a trill null is detected at 910, then the trill gain, such as the trill gain illustrated at 806 of FIG. 8, is applied to sample gains for the $1^{st}$ or $2^{nd}$ sub frame indicated by the received trill null position info at 912, for example as illustrated by the audio sample gain at 808 of FIG. 8.

If the current sub frame is attenuated by sample gains, then the amplitude of a predetermined time portion of the next sub frame can be boosted at 914. For example, the amplitude of the first 5 ms of the next sub frame can be boosted according to the trill depth value of the current frame. If the current sub frame needs to be attenuated by X dB, then sample gains of the next 5 ms can be boosted by:

$$a*X \text{ dB},$$

where "a" is a predefined scaling factor. This approach compensates for the vocoder which tends to smooth the amplitude of consecutive voice frames/sub frames, then reduce the energy of the trill peak that follow a trill null. The sample gains may be smoothed over time at 916, as was shown at 812 of FIG. 8, to avoid a sudden change in the speech samples after the gains have been applied.

Accordingly, the various embodiments have provided trill enhancement approaches and methods. The parallel and post-processing elements provided by the various embodiments provide improved audio quality without incurring delays and without altering the vocoder. The use of the parallel and post-processing, in accordance with the various embodiments, will enhance the performance of radio products that use narrowband vocoders, particularly the MBE type vocoders used in P25 systems. The use of the parallel and post-processing operating in accordance with the various embodiments helps reproduce alveolar (i.e. trilled) 'r' and other sounds thereby promoting the acceptance and sale of narrowband digital radio systems.

The IMBE/AMBE vocoder is a standard required for compatibility and interoperability in P25 (DMR) system radios. The improved intelligibility for certain speech sounds will improve the marketability of products incorporating the speech enhancement approaches provided by the various embodiments. The parallel and post-processing technology improves the quality and intelligibility of vocoded speech providing an improved performance and marketing advantage. Other low frame rate vocoders, such as the ACELP vocoder used in TETRA systems can also take advantage of the improved intelligibility.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A communication system, comprising:

a digital vocoding system for receiving digitized audio frames at a transmit radio and generating a decoded audio signal at a predetermined frame rate from a receive radio;

a processing module of the transmit radio detecting a trill null in the digitized audio frames and extracting trill information comprising trill null position and trill modulation depth, the trill information being transmitted from the transmit radio to the receive radio; and a processing module of the receive radio generating linear gain values based on the trill null, the trill modulation depth and the trill null position, the linear gain values being applied to the decoded audio signal to generate a recovered audio signal having a reconstructed trill null.

2. The radio of claim 1, wherein the processing module of the transmit radio comprises a trill encoder, and the processing module of the receive radio comprises: a trill decoder and a trill reconstructor.

3. The radio of claim 2, wherein the trill encoder codes the trill information into signaling bits.

4. The radio of claim 3, wherein the trill encoder sends the signaling bits to the trill decoder using a signaling bits channel.

5. The radio of claim 3, wherein the trill encoder divides the digitized audio frames into sub frames and extracts features from consecutive sub frames, wherein the extracted features from consecutive frames provide the trill information.

6. The radio of claim 5, wherein the extracted features comprise change in amplitude or root mean square (rms) of two consecutive sub frames.

7. The radio of claim 6, wherein the feature extraction is accomplished by the trill encoder band pass filtering the sub frames to obtain a voiced sound band energy and then calculating a maximal absolute amplitude or rms level for each sub frame, and setting a limit for background noise.

8. The radio of claim 1, wherein the processing module of the receive radio comprises:

a trill decoder which extracts the trill bits from a signaling bits channel and decodes the extracted trill bits to obtain recovered trill null position and recovered trill modulation depth.

9. The radio of claim 2, wherein the trill reconstructor determines a trill detect flag.

10. The radio of claim 9, wherein the trill detect flag is determined by comparing the recovered trill modulation depth to a predetermined value to represent a null.

11. The radio of claim 10, wherein in response to the trill detect flag indicating a null, the trill reconstructor converts the recovered trill depth into a trill gain, the trill gain being a linear gain value.

12. The radio of claim 11, wherein the trill reconstructor generates sample linear gain values based on the trill null position, the trill gain, and the trill detect flag of current and previous audio frames.

13. The radio of claim 12, wherein the trill reconstructor:

boost the sample linear gain values of a predetermined number of next audio samples;

smoothes the sample linear gain values over time;

delays the sampled linear gain values to align with the decoded audio signal incoming into the reconstructor; and recovers the trill within a recovered audio output signal by applying the delayed linear sample gains to the decoded audio signal.

14. The radio of claim 2, wherein the digital vocoding system comprises:

a vocoder encoder at the transmit radio;

a vocoder decoder at the receive radio; and the digitized audio frames being supplied as parallel inputs to both the vocoder encoder and the trill encoder of the transmit radio; and the decoded audio signal being generated from the vocoder decoder of the receive radio, and the recovered trill information being generated by the trill decoder of the receive radio;

both the decoded audio signal and the recovered trill information being provided as inputs to the trill reconstructor thereby providing a combination of parallel and post-processing.

15. A method for enhancing audio processing between a transmit radio and a receive radio, comprising:

receiving digitized audio frames at a vocoder encoder of the transmit radio;

generating a decoded audio signal from a vocoder decoder of the receive radio; and at a processing module of the transmit radio:

detecting trill nulls within the received digitized audio frames;

coding of the trill nulls into trill information bits;

at a processing module of the receive radio:

decoding the trill information bits;

recovering trill information from the decoded trill information bits; and reshaping the decoded audio signal based on the recovered trill information.

16. The method of claim 15, wherein coding of the trill nulls into trill information bits comprises:

dividing a digital audio frame from the received digitized audio frames into sub frames;

extracting features from the sub frames;

detecting trill information comprising trill null position and trill modulation depth, based on the extracted features; and quantizing the trill information into trill information bits.

17. The method of claim 16, wherein extracting features from the sub frames further comprises:

bandpass filtering the sub frames;

calculating maximal absolute value of amplitude or rms level of each sub frame; and setting noise limits.

18. The method of claim 16, wherein detecting trill information further comprises:

calculating amplitude changes of two consecutive sub frames; and iterating the detection of trill null position and trill modulation depth.

19. The method of claim 15, wherein recovering trill information from the decoded trill information bits comprises:

decoding the trill information bits to obtain trill null position; and mapping modulation depth in decibels (dB).

20. The method of claim 15, wherein the detecting and coding are done by a trill encoder stage of the processing module of the transmit radio, and the decoding and recovering are done by a trill decoder stage of the processing module of the receive radio, and the reshaping is done by a trill reconstructor of the processing module of the receive radio.

21. The method of claim 15, wherein the reshaping comprises:

determining sample gains based on recovered trill information and predefined parameters; and applying the sample gains to the decoded audio signal.

22. The method of claim 21, wherein the predefined parameters comprise:

algorithm delay of the vocoder encoder and vocoder decoder; and upper and lower thresholds of the sample gains; and smoothing factors for sample gains when ramping down and ramping up.

23. The method of claim 22, further comprising:

delaying the application of the sample gains for alignment with the decoded audio signal.

* * * * *